US009121149B2

(12) United States Patent
Sharp et al.

(10) Patent No.: US 9,121,149 B2
(45) Date of Patent: Sep. 1, 2015

(54) POSTS FOR ROAD SAFETY BARRIER

(75) Inventors: Graham T. Sharp, Retford (GB); Sean Billingham, Wollescote (GB); John M. Walton, Doncaster (GB); Steve Eldon Wells, Yukon, OK (US); Matt Harriman, Swadlincote (GB)

(73) Assignee: Hill & Smith Limited (GB)

( * ) Notice: Subject to any disclaimer, the term of this patent is extended or adjusted under 35 U.S.C. 154(b) by 820 days.

(21) Appl. No.: 13/174,838

(22) Filed: Jul. 1, 2011

(65) Prior Publication Data

US 2012/0001138 A1 Jan. 5, 2012

Related U.S. Application Data

(63) Continuation-in-part of application No. 12/371,735, filed on Feb. 16, 2009, which is a continuation of application No. 10/942,240, filed on Sep. 15, 2004, now Pat. No. 7,497,640.

(30) Foreign Application Priority Data

Sep. 17, 2003 (GB) ..... 0321757.7

(51) Int. Cl.
*E01F 15/00* (2006.01)
*E01F 15/06* (2006.01)
(Continued)

(52) U.S. Cl.
CPC ..... *E01F 15/06* (2013.01); *E01F 15/0461* (2013.01); *E04H 17/02* (2013.01)

(58) Field of Classification Search
CPC ..... E01F 15/06; E01F 13/00; E04H 17/02
USPC ..... 404/6, 9–11; 256/1, 13.1
See application file for complete search history.

(56) References Cited

U.S. PATENT DOCUMENTS 429,038 A 5/1890 Kerr, Sr.
620,950 A * 3/1899 Morgan ..... 256/47
962,632 A 6/1910 Frost
(Continued)

FOREIGN PATENT DOCUMENTS

BE 657 233 A 4/1965
DE 1 784 768 A1 11/1971
(Continued)

OTHER PUBLICATIONS

European Patent Office, "Communication pursuant to Article 94(3) EPC", European Search Report, May 17, 2013, 7 pages.
(Continued)

*Primary Examiner* — Raymond W Addie
(74) *Attorney, Agent, or Firm* — Tomlinson Rust McKinstry Grable

(57) ABSTRACT

A road safety barrier having a plurality of ropes supported by posts rigidly mounted on or in the ground is described. Each rope is held in tension against the posts and supported in a longitudinally oriented indentation in a side of the posts. The ropes are released from a post and the post is not pulled from the ground when a vertical force is exerted on the rope. The post may have a circular cross-section and the indentation has a bottom oriented substantially parallel to the ground such that the rope is biased to exit upward out of the indentation. The ropes when weaved are tensioned against the posts and this gives rise to a combined frictional resistance to displacement of the ropes relative to each post along the length of the safety barrier.

21 Claims, 6 Drawing Sheets

(51) Int. Cl.

| | |
|---|---|
| ***E01F 15/04*** | (2006.01) |
| *E04H 17/02* | (2006.01) |

(56) References Cited

U.S. PATENT DOCUMENTS

| | | | | | |
|---|---|---|---|---|---|
| 1,793,106 | A | * | 2/1931 | Lindemuth | 256/57 |
| RE22,060 | E | * | 4/1942 | Hayden et al. | 256/13.1 |
| 2,861,122 | A | * | 11/1958 | Flower | 174/146 |
| 3,266,778 | A | | 8/1966 | Wogerbauer | |
| 3,292,909 | A | * | 12/1966 | Bianchi | 256/13.1 |
| 3,351,322 | A | | 11/1967 | Mueller | |
| 3,353,795 | A | | 11/1967 | Muller | |
| 3,450,387 | A | | 6/1969 | Thomas | |
| 3,521,862 | A | * | 7/1970 | Curtner | 256/13.1 |
| 3,567,184 | A | | 3/1971 | Yancey | |
| 3,722,861 | A | | 3/1973 | Anderson | |
| 4,223,872 | A | | 9/1980 | Boal | |
| 4,357,001 | A | * | 11/1982 | Schmanski et al. | 256/51 |
| 5,022,782 | A | | 6/1991 | Gertz et al. | |
| 5,039,066 | A | | 8/1991 | Stacey | |
| 5,085,409 | A | | 2/1992 | Teixeira | |
| 6,065,738 | A | * | 5/2000 | Pearce et al. | 256/13.1 |
| 6,454,244 | B1 | | 9/2002 | Coulson | |
| 6,612,551 | B1 | * | 9/2003 | Roy | 256/1 |
| 6,886,813 | B2 | | 5/2005 | Albritton | |
| 6,962,328 | B2 | * | 11/2005 | Bergendahl | 256/13.1 |
| 8,246,013 | B2 | * | 8/2012 | Mauer et al. | 256/48 |
| 2002/0185639 | A1 | * | 12/2002 | Galivan | 256/32 |
| 2006/0175591 | A1 | * | 8/2006 | Caesar | 256/32 |
| 2013/0207060 | A1 | * | 8/2013 | Tonks et al. | 256/13.1 |

FOREIGN PATENT DOCUMENTS

| | | | |
|---|---|---|---|
| DE | 3533963 | A | 4/1986 |
| EP | 0 369 659 | A1 | 5/1990 |
| FR | 2816344 | A | 5/2002 |
| GB | P20178 | A | 3/1915 |
| GB | 1012212 | B | 12/1965 |
| GB | 1103873 | B | 2/1968 |
| GB | 1120959 | B | 7/1968 |
| GB | 2224528 | A | 5/1990 |
| WO | 96/23473 | A1 | 9/1996 |
| WO | 00/67264 | A1 | 11/2000 |
| WO | 02/18730 | A1 | 3/2002 |
| WO | 03/024205 | A1 | 3/2003 |

OTHER PUBLICATIONS

Australian Government IP Australia, "Examiner's first report on patent application No. 2004212563", Mar. 5, 2009, 2 pages.
Australian Government IP Australia, "Examiner's report No. 2 on patent application No. 2009201382", Nov. 1, 2011, 2 pages.
Australian Government IP Australia, "Examiner's report No. 3 on patent application No. 2009201382", Feb. 21, 2012, 3 pages.
The Patent Office, "Patents Act 1977: Search Report under Section 17(5)", Feb. 12, 2004, 3 pages.
The Patent Office, "Patents Act 1977: Examination Report under Section 18(3)", Mar. 23, 2006, 3 pages.
The Patent Office, "Patents Act 1977: Examination Report under Section 18(3)", Jun. 15, 2006, 5 pages.
Subramaniam, Nataraj & Associates, "First Examination Report issued by the Patent Office", Jul. 8, 2008, 5 pages.
Australian Government IP Australia, "Examiner's first report on patent application No. 2004212563", Oct. 15, 2010, 3 pages.

* cited by examiner

POSTS FOR ROAD SAFETY BARRIER

CROSS REFERENCE TO RELATED APPLICATIONS

This application is a continuation-in-part of U.S. Ser. No. 12/371,735, which is a continuation of U.S. Ser. No. 10/924,240, filed Sep. 15, 2004, which claims priority to United Kingdom Patent Application No. 0321757.7, filed Sep. 17, 2003, which are incorporated herein by reference.

FIELD OF THE INVENTION

This invention relates to road safety barriers for use at the sides or central reservations of roads and motorways, and in particular these including a plurality of wire ropes interwoven and maintained under tension between supporting posts.

SUMMARY OF THE INVENTION

According to the present invention, there is provided a road safety barrier comprising four or more ropes supported by posts rigidly mounted on or in the ground, each rope being held in tension against the posts and following a sinuous path between the posts.

The invention is directed to a post for use with, a road safety barrier. The road safety barrier has a plurality of wire topes, each rope supported by a plurality of posts. The post comprises a vertical member and a first longitudinally oriented indention. The indention is formed in the vertical member to receive and support a first wire rope. The indention comprises a top and a bottom. The bottom is substantially parallel with the ground such that the first wire rope may be released either upwards or downwards from the indention when force is exerted on the first wire rope.

Another embodiment of the invention is directed to a road safety barrier. The barrier comprises a plurality of posts and a plurality of ropes supported on the posts. Each post comprises a longitudinally oriented indention formed on a first side of the posts. The barrier further comprises a plurality of ropes supported by the posts, the ropes held in tension along the length of the barrier and within at least one of the longitudinally oriented indentions. At least one of the longitudinally oriented indentions comprises a top and a bottom. The bottom is substantially parallel with the ground such that the first wire rope may be released either upwards or downwards from the indention when force is exerted on the first wire rope.

Yet another embodiment of the invention is directed to a wire rope support for use in a road safety barrier. The support comprises a vertical member and a first longitudinally oriented indention formed in a first side of the vertical member. The indention comprises a top and a perforated bottom wherein the bottom is substantially parallel with the ground such that the wire rope may rest within the indention.

In embodiments of the invention, the tensioning of the ropes against the posts gives rise to a combined frictional resistance to displacement of the ropes relative to each post or at least some of the posts along the length of the safety barrier. The structure of each, post and/or its/their mounting with respect to the ground defines a minimum bending yield strength in a direction along the length of the barrier. This minimum bending yield strength is advantageously greater than the bending moment resulting from the combined frictional, resistance forces acting on the post.

Notwithstanding the above it is highly desirable that all (or most) of the posts exhibit a preferential mode of collapse in a direction along the length of the safety barrier, relative to a transverse direction, so that they do not project from the line of the fence after an accident.

Embodiments of the present invention may provide an enhanced vehicle restraint capability relative to the four-wire rope fence described in EP 0 369 659 A1 particularly in cases involving larger and heavier vehicles. Further ropes may be interwoven between the posts to create a multi-rope barrier in order to achieve an increased containment capability although additional ropes to the minimum four are preferably added in pairs so the total number of ropes is even. This is so that the barrier has a more consistent resistance to vehicle penetration along its length. The ropes may be arranged in pairs at different heights on the posts or alternatively each rope may be at a different height from the others. In the latter case, the dispersion of the ropes allows the barrier to better accommodate a wide variety of vehicle types/heights and reduces the risk of rope redundancy in terms of vehicle capture.

Rope supports may be provided on the posts for vertically locating the ropes thereon while permitting longitudinal movement in the direction of the plane of the barrier. The rope supports may be formed integrally in the posts, possibly by way of longitudinally disposed notches. Alternatively the ropes may be supported on frangible supports such as rollers mounted on the posts.

The posts may have an asymmetrical cross-sectional profile such that the post presents the same profile to oncoming traffic on both sides of the barrier. This is, when the post is installed in the ground, rounded corners of the post are presented to oncoming traffic travelling in, opposite directions on either side of the barrier. For example, the cross-sectional profile of the post may be of "S" or "Z", preferably with rounded corners on the line of bend so that a rounded corner is presented to oncoming traffic. The S-post is therefore to be preferred in the central reservation of dual carriageways where vehicles drive on the left-hand side of the road, whereas the Z-post is preferable in the near-side verges. The opposite choice would naturally prevail in right-hand drive countries. A circular cross-section may also be used to present a rounded surface in all directions, and provide ease of manufacture.

Embodiments of the present invention are advantageous in that when a vehicle impacts the barrier, there is an enhanced vehicle containment/retardation capability and a reduced risk of post collapse or damage in the regions of the barrier up and downstream of the impact area.

BRIEF DESCRIPTION OF THE DRAWINGS

The invention will now be further described by way of example with reference to the accompanying drawings, in which like reference numerals designate like elements, and in which.

DESCRIPTION OF THE PREFERRED EMBODIMENTS

Figure 1:
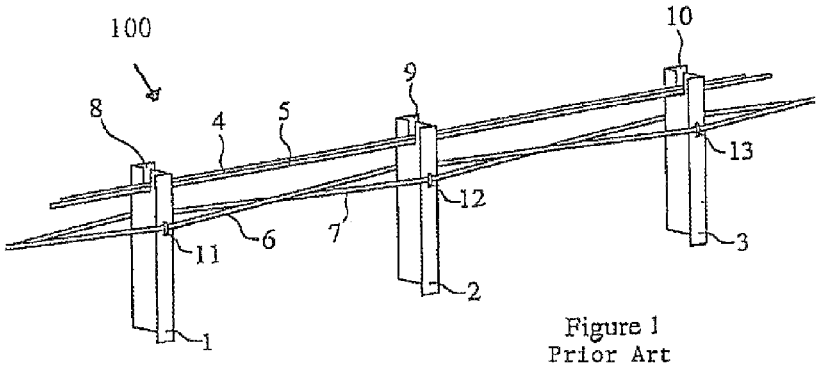
Figure 1 Prior Art
FIG. 1 shows part of a road safety barrier described in EP 0 369 659 A1.

A known wire rope road safety barrier, described in EP 0 369 659 A1 and shown in FIG. 1, includes two pairs of wire ropes, one pair of upper ropes supported in slots provided in a number of posts and lying generally parallel to one another, and a lower pair of ropes held in tension against and in contact with opposite side edge surfaces of posts. Each lower cable follows a sinuous path and passes to a different one of the two side surfaces of the same post. Although this safety barrier design added substantially to the containment capability over an earlier two wire rope barrier, it is now recognized that there are disadvantages associated with the parallel arrangement of the upper ropes because they have very little connectivity/cohesion with the posts. Consequently the upper ropes behave less stiffly and have less energy absorption capability than the (interwoven) lower ropes. Also because of the vertical rigidity of the posts there is a possibility of an errant vehicle straddling the safety barrier and receiving an upward thrust leading to overturning of the vehicle, if the posts fail to collapse in time.

It is desirable to achieve a degree of pre-tensioning of the interwoven wire ropes such that the integrity of the barrier is maintained during the mediate post-crash period. However, a consequence of the pre-tensioning is a tendency for the interwoven ropes to grip the posts so tightly that their combined frictional grip in the direction of the line of the barrier exceeds the elastic bending strength of the posts in that direction. This can lead to posts located some distance away from the vehicle impact zone being pulled over by the ropes towards the vehicle to the extent that they are permanently deformed. It is an aim of the present invention to provide a road safety barrier which alleviates the aforementioned problems.

Referring now to the figures in general and FIG. 1 in particular, shown therein is a road safety barrier, referred to generally by reference number 100. The road safety barrier 100 comprises a plurality of posts 1, 2, 3, a plurality of ropes 4, 5, 6, 7, and a plurality of supports 11, 12, 13.

In the arrangement shown in FIG. 1, posts 1, 2 and 3 are inserted into the ground (not shown) and support two pairs of wire ropes 4, 5 and 6, 7. The posts may be inserted into the ground either into recesses in pre-cast footings or by any other suitable means. The posts 1, 2, 3 may be made from steel pressings having, for example, an "S" or "Z" cross-section such that a rounded corner of the line of the bend is offered to the direction of the traffic instead of a sharp edge. The post 1, 2, 3 shape takes the form of a vertical member which presents a smooth conforming surface to the ropes 4, 5, 6, 7, and a smooth radiussed surface to any other impacting bodies so as to minimize the damage thereto under collision conditions.

The ropes 4, 5 of one pair are parallel to one another and supported within notches 8, 9 and 10 provided within respective posts 1, 2 and 3. The ropes 6, 7 of the other pair are interwoven between the posts in the manner illustrated and supported in a vertical direction on the side of the posts by way of supports 11, 12 and 13. Each rope is maintained under tension so that the barrier provides an effective restraint to errant vehicles.

Figure 2:
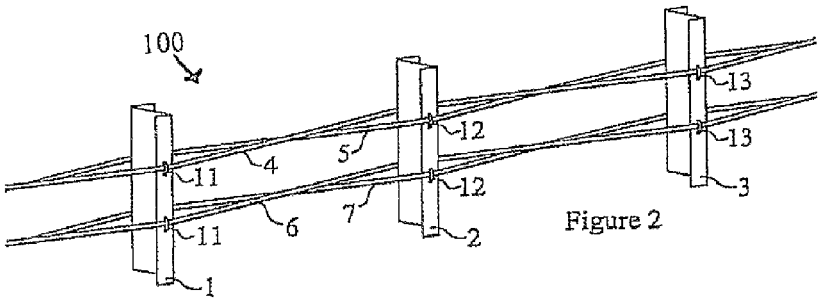
FIG. 2 shows a section of a road safety barrier according to a first embodiment of the present invention.
Figure 3:
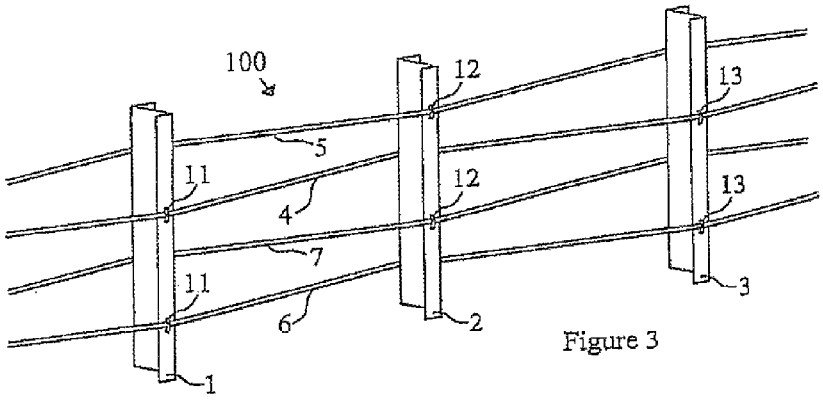
FIG. 3 shows a section of a road safety barrier according to a second embodiment of the present invention.

In the first embodiment of the present invention, as illustrated in FIG. 2, the ropes of both pairs 4, 5 and 6, 7 are interwoven about the posts 1, 2 and 3 of the barrier 100 instead of only the lower pair 6, 7. Each of the ropes is supported in a vertical direction on the side of the posts by way of supports 11, 12 and 13. The ropes of the first pair 4, 5 are at substantially the same height above the ground as one another and the ropes of the second pair 6, 7 are also at substantially the same height above the ground as one another but lower than the first pair. In the second embodiment, illustrated in FIG. 3, all of the ropes 4 to 7 of the barrier 100 are interwoven but instead of being arranged in two pairs vertically spaced apart from one another, all of the ropes are vertically spaced apart with respect to one another at different heights above the round. The first and second embodiments have the advantage, relative to the prior art arrangement illustrated in FIG. 1, that the containment capability of the barrier is improved and the risk of an impacting vehicle overturning is reduced for a wider range of vehicle weights and sizes. It is noted that FIGS. 2 and 3 illustrate a preferred method of interweaving in that each of the ropes 4, 5, 6, 7 passes from one side of the first post to the alternate side of the next one and so on progressively along the length of the barrier 100. It is preferred for the interweaving of half of the ropes 4, 5, 6, 7 to be arranged out of phase with the other half and in a manner which balances the potential bending moments on the respective posts, to ensure a consistent resistance to penetration (by vehicles) along the length of the barrier 100.

Figure 4:
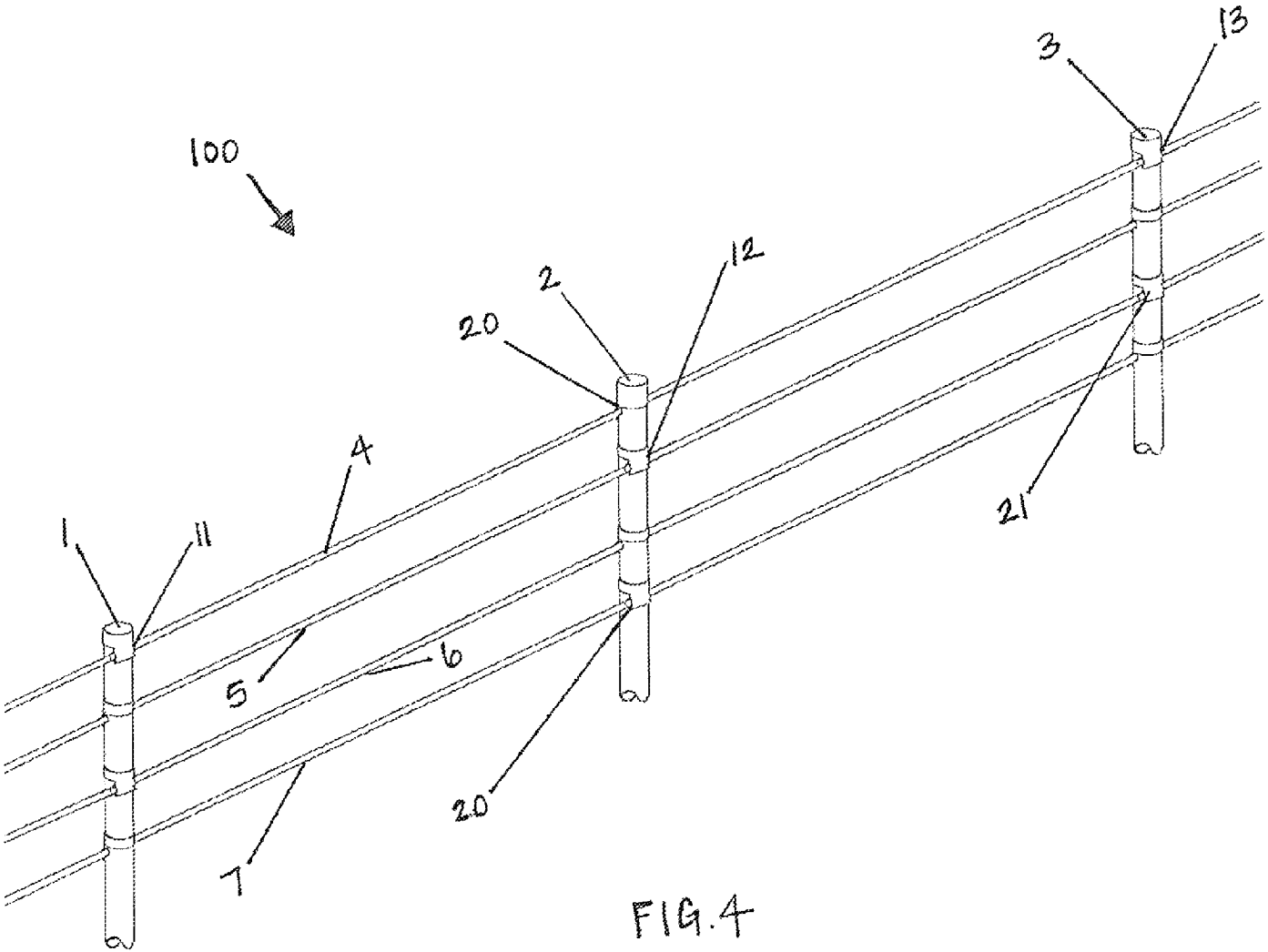
FIG. 4 is a perspective view of a road safety barrier having posts with a circular cross-section.

With reference now to FIG. 4, shown therein is a barrier 100 comprising posts 1, 2, 3 with a circular cross-section. Ropes 4, 5, 6, 7 interweave between posts 1, 2, 3. The supports 11, 12, 13 comprise longitudinally oriented indentions 20 formed in the posts 1, 2, 3. The indentions may be covered by retaining rings 21 supported on posts 1, 2, 3. The rings 21 are supported on the posts 1, 2, 3 and may prevent small forces from displacing ropes 4, 5, 6, 7 from the indentions 20. The rings 21 are preferably made of a material, such as plastic, which does not possess the strength to retain the wire ropes 4, 5, 6, 7 within the indentions 20 upon application of a force consistent with a vehicle collision.

Figure 5:
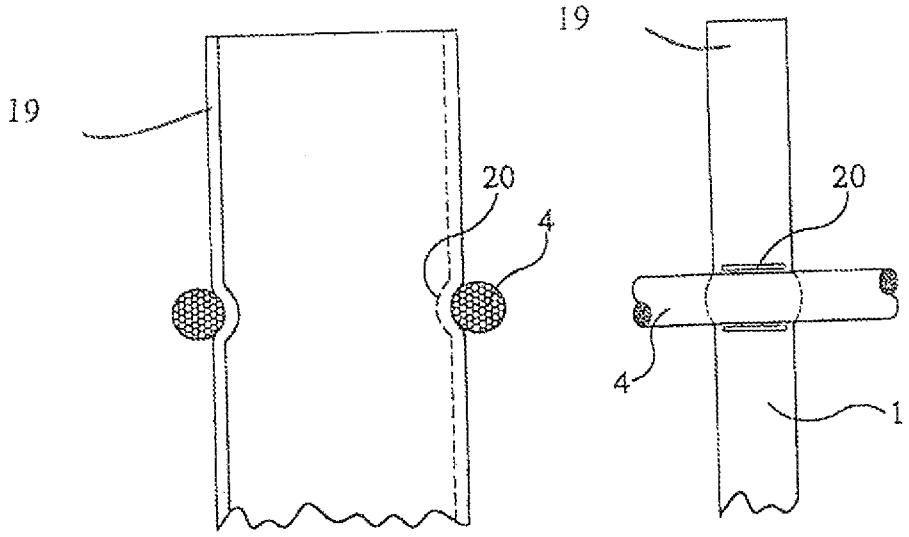
FIG. 5 shows a sectional side view of a post having a "Z" cross-section which may be adopted in embodiments of the present invention.

With reference now to FIG. 5, shown therein is a part view of the "S or Z" post 1 with the rope 4 located within the longitudinally orientated indentions 20 provided in the post. The indentions 20 are located in a flange 19 of the S or Z-shaped cross-section. This enables smooth supporting of the ropes as well as simple and accurate positioning thereof at predetermined heights on the one hand while allowing the ropes to be released from the notch if a significant vertical force is exerted on the rope 4. The release of the rope 4 from the post 1 when subjected to an upward or downward force avoids the rope applying any upthrust to the vehicle and the possibility of the post 1 being pulled out of the ground.

Figure 6:
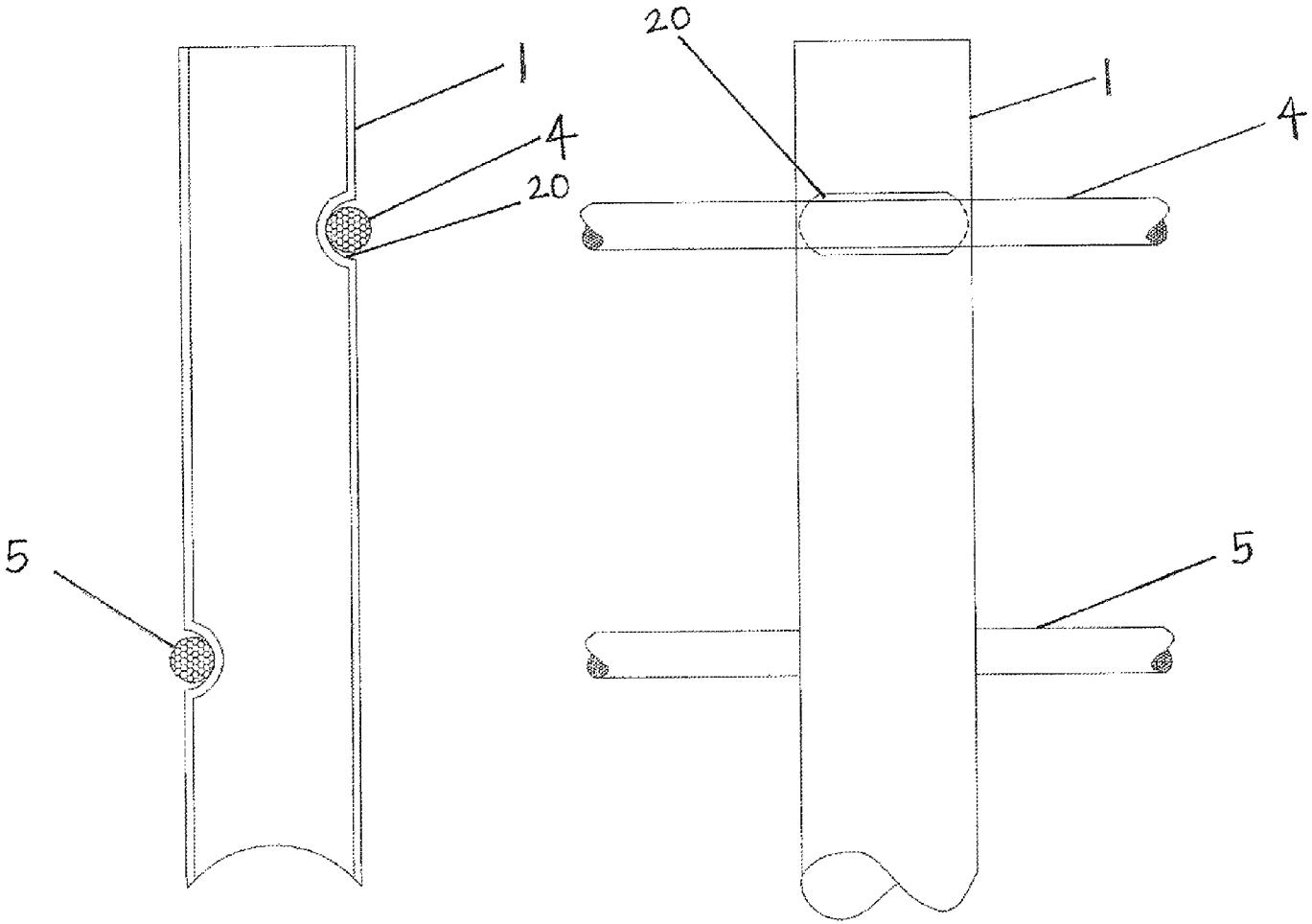
FIG. 6 shows a sectional side view of a post having a circular cross-section which may be adopted in embodiments of the present invention.

With reference now to FIG. 6, a sectional view of the post 1 with a circular cross-section is shown. The longitudinally orientated indention 20 is formed in a wall of the post 1 and supports the rope 4. Further, the ring 21 (FIG. 4) may be provided about the post 1 to hold the rope 4 in place unless a significant vertical force is exerted on the rope. As shown, a second rope 5 is located on a second side of the post 1.

Figure 7:
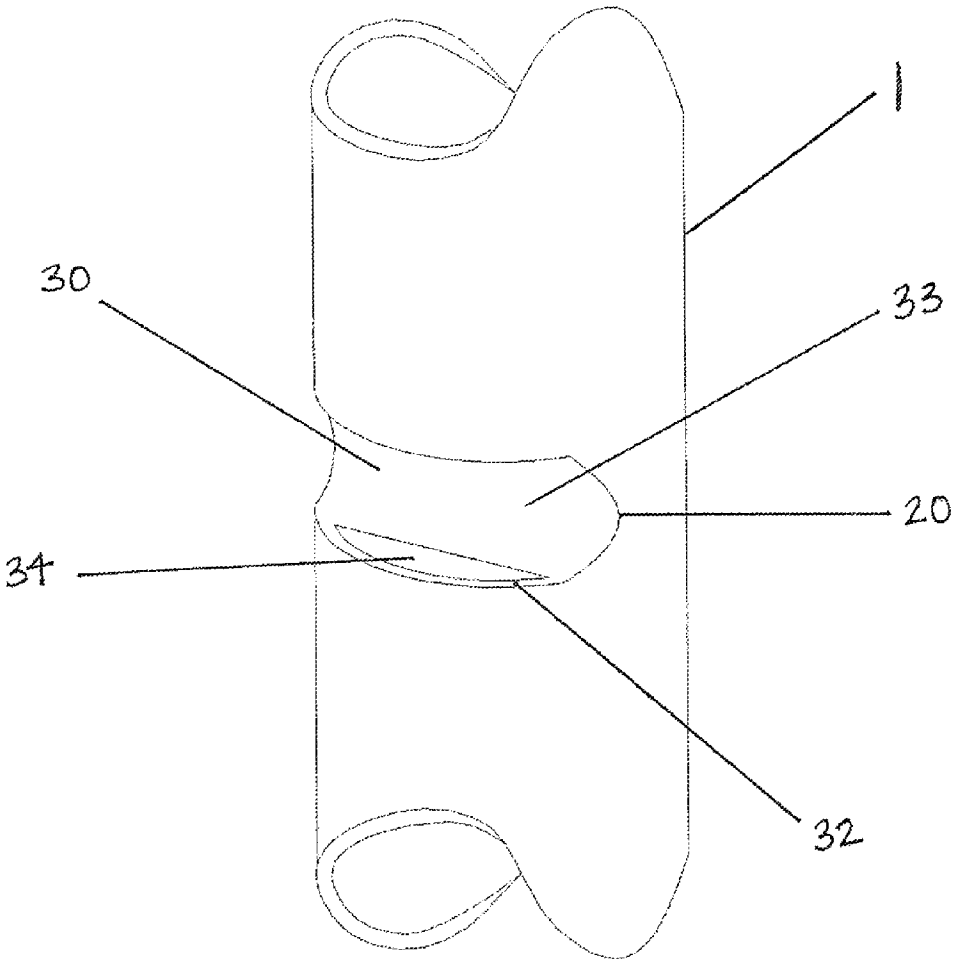
FIG. 7 is a sectional perspective view of a post having an indention.

With reference to FIG. 7, a more detailed view of the indention 20 of the post 1 is shown. The indention 20 comprises a top 30 and a bottom 32. As shown, the top 30 comprises a concave wall 33 longitudinally oriented on a side of the post 1 for receiving a rope (FIG. 6). The bottom 32 comprises a perforation 34 and is substantially parallel to the ground. The perforation 34 is created by the process of manufacturing the posts 1 with indentions 20, and provides a horizontal surface parallel to the ground for the wire, rope 4 to rest. As shown, the perforation 34 is semicircular and is substantially the width of the bottom 32.

As discussed above, it is advantageous for the rope 4 (FIG. 6) to release from the post 1 when subjected to an upward or downward force. As shown in FIG. 7, the flat bottom portion 32 biases the rope 4 against releasing downward and in favor of releasing upward, while allowing release in either direction. While the top portion 30 is concave and curved as shown, the top portion may alternatively be set at a 45 degree angle relative to the side of the post, convex, or any other configuration which generally biases the wire rope to exit the indention 20 in an upward rather than downward direction. The post 1 may further comprise a lip (not shown) extending proximate the bottom portion 32 to further bias the wire rope to exit in an upward direction.

Embodiments of the present invention are advantageous in that they reduce the extent of separation of the wire rope from the road safety barrier posts outside the vehicle impact zone. Consequently, the integrity of the road safety barrier outside the immediate impact zone is maintained. The profile of the indention 20 or cut-out is such as to resist downward movement of the wire rope 4 but permit upward deflection of the wire rope outside the vehicle impact area. Embodiments of the present invention may include road safety barriers that have wire ropes woven sinuously about the posts or barriers having wire ropes that run parallel (i.e. non-woven) to the line of the barrier.

As may be seen, the post 1 holds the wire rope 4 within the indention 20. The indention 20 is recessed within an outer surface of the post 1 and is preferably formed by making a single cut into the post and pressing the surface of the post inwards to form the curved top 30 and flat bottom 32.

In use, the wire rope 4 sits on the bottom 32. The bottom 32 prevents the wire rope 4 from falling downwardly towards the ground either in-situ, during impact with a vehicle, or in some instances after impact with a vehicle. During impact, the wire rope 4 will therefore preferentially move upwards riding along the top portion 30. The additional advantages of providing a concave wall 33 for the top portion 30 rather than a complete cutaway is that the wire rope 4 is held against the wall 33, maximizing the surface area and therefore the friction between the wire rope 4 and the post 1. The bottom 32 also prevents the wire rope 4 from moving downwards towards the ground, and the top portion 30 of the indention 20 channels upward movement of the wire rope 4.

One skilled in the art will appreciate that the perforation 34 is not used in an indention on the post 1 near the ground, to increase the structural integrity of the post. This indention therefore comprises an arcuate top and arcuate bottom (not shown).

The release of the wire rope 4 from the post 1 is necessary to minimize the impact zone and the extent of the road safety barrier 100 affected by an impact, or more pertinently, to ensure that the road safety barrier provides a degree of give or movement during impact and does not act as a solid immoveable object. The primary advantage of this embodiment is that the release of the wire rope 4 from the post 1 is not instantaneous upon impact—rather the wire ropes 4, 5, 6, 7 are held against the posts 1, 2, 3 for long enough to prevent the initial shockwave of the impact that travels along the wire ropes (the 'whip' of the rope) from causing the wire ropes to separate from a large number of posts away of the impact point.

Each of the ropes 4 to 7 is pre-tensioned by means of ground anchors at suitable intervals along the highway. The tension may be applied, for example, by temporary jacking means and adjustable rope anchorages, or by threaded end connectors and bottle screws (not shown). Intermediate tensioning means may be introduced to permit the end anchorages to be more widely separated.

During installation of the safety barrier, steps should be taken to ensure that the pre-tensioning of the wire ropes 4 to 7 is such that the tension is uniformly distributed along the barrier between the anchorage points. In a preferred embodiment, the bottom rope 7 is placed through an indention 20 that comprises a curved surface without a parallel bottom.

In a preferred embodiment of the present invention, the yield strength of the posts in the longitudinal direction of the safety barrier exceeds the combined bending moments due to the normal frictional forces of the ropes on the posts under the expected tensions in the system. The significance of the post-rope frictional resistance and its bearing on the performance of the safety barrier will be explained in more detail below tinder the heading "Safety Barrier Crash Performance".

The posts should be designed to be secured in the ground in a manner capable of resisting the (longitudinal and transverse) bending moments on the post prior to and during its collapse under vehicle impact conditions, having regard to the prevailing ground conditions.

The post cross-section may be of any size and shape which satisfies the above criteria, and may vary in dimensions along the length of the barrier to reflect differing requirements, e.g. curves in the highway and/or changing post spacing.

Examples of Possible Z-Post Sections

| Superficial dimensions of post cross-section mm | | | $2^{nd}$ Moment of Inertia $mm^4$ | |
|---|---|---|---|---|
| Depth | Width | Thickness | In plane of barrier | Normal to barrier |
| 100 | 32 | 5.0 | 59,000 | 914,000 |
| 100 | 32 | 6.0 | 66,700 | 1,064,000 |
| 100 | 40 | 6.0 | 125,000 | 1,280,000 |
| 110 | 40 | 6.0 | 130,000 | 1,625,000 |
| 110 | 50 | 6.0 | 242,000 | 1,960,000 |
| 120 | 40 | 6.0 | 135,000 | 2,016,000 |
| 120 | 50 | 6.0 | 245,000 | 2,420,000 |
| 120 | 50 | 8.0 | 307,000 | 3,070,000 |

It may also vary in flexural stiffness along the length of the post to take account of the varying bending moment. The type of section will therefore preferably lend itself to being manufactured by processes which can readily accommodate changes in size and shape without incurring prohibitive costs for tooling and the like.

The posts shall be of such a cross-section that they not only provide the barrier with adequate resistance to vehicle penetration (transverse to the line of the barrier) but also have a preferential mode of collapse in the direction of the line of the barrier. This is achieved by making the second moment of area of the posts in the longitudinal direction (in the plane of the barrier) significantly less than its second moment of area in the transverse direction (normal to the barrier) as illustrated in the above table. In order to comply safely with this requirement it is expected that the depth of the post cross-section is preferably in the region of 2-3 times the width thereof.

The constructional design detail of the rope tendons is believed non-critical to the initial functionality of the barrier so long as the ultimate strength and axial stiffness of the ropes are correctly specified, in keeping with the expected (crash) performance of the barrier. However the 19 mm diameter 3×7(6/1) rope is commonly used at present in this application and is a suitable rope for use in barriers embodying the present invention. This type of rope is favored both for ease of manufacture/handling, and for its structural integrity when subjected to mechanical abrasion/abuse. In addition it is substantially torque balanced under load which facilitates pre-tensioning and avoids undesirable rotational displacements in service.

However to optimize the functionality of the barrier in the immediate post-crash period steps should be taken to minimize the loss in rope tension when the barrier is impacted by a vehicle. In addition to ensuring that the barrier is uniformly pre-tensioned along its length, the ropes should be pre-stretched at a tension equivalent to 50% of their breaking strength, to remove initial stretch and elevate the elastic limit of the wire rope. Typically such ropes will have a minimum breaking strength of 174 kN and an axial stiffness of at least 23 MN.

The level of pre-tension applied to the wire ropes during installation of the barrier maybe regarded as an important variable in determining, the crash performance of the barrier, with particular regard to vehicle deceleration rates and the permissible level of penetration beyond the line of the barrier. Normally for effective containment the ropes will be pre-tensioned to a tension equal to at least 10% of their breaking strength, and preferably to a tension equivalent to about 15% of their breaking strength and even up to a level equivalent to about 20% of their breaking strength where other design and practical considerations allow.

Safety Barrier Crash Performance:

The use of parallel top ropes in the prior art barrier illustrated in FIG. 1 is advantageous in that it is easy to apply and maintain tension in those elements of the system. Specifically, the frictional resistance between the ropes and the post slots (in which they are a loose fit) is so low that that tension is readily transmitted over long lengths simply by tightening up the bottle screws at the anchorage points. This has the added benefit that in the event of a vehicle collision with the fence, there is little loss in tension in the top ropes and their functionality is largely maintained, thus preserving the integrity of the barrier until repairs can be effected. On the other hand, the use of interwoven top ropes increases the dynamic stiffness of the barrier and its energy absorption capability, thus improving the primary safety of the barrier.

Figure 8:
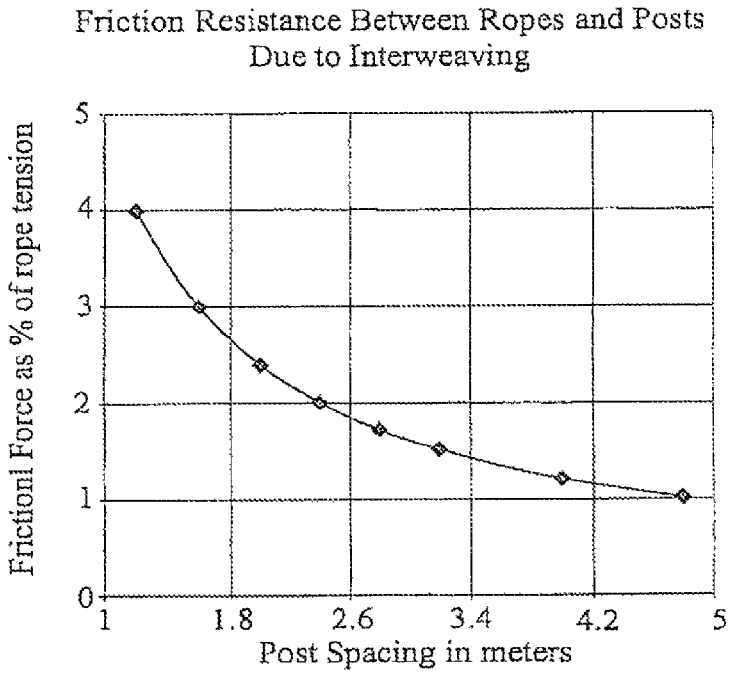
FIG. 8 is a graph showing frictional resistance between ropes and posts due to interweaving.

Embodiments of the invention adopt interwoven ropes in place of the prior art parallel top rope arrangement. However, interwoven ropes are more difficult to pre-tension, because the angular deflection of the ropes creates a proportional increase in the frictional resistance to movement between them and the posts. Typically the ropes are deflected from the line of the barrier by 2-3 degrees, but at shorter post spacing the angular deflection increases rapidly and may reach 5 degrees or more. The effect of this on the frictional resistance between the ropes and the posts is illustrated in FIG. 8. This figure takes the example of a 19 mm (¾") dia. rope on 100 mm (4") deep posts, and assumes a coefficient of friction=0.20.

This tensioning difficulty can be overcome by adopting an iterative tensioning procedure. The ropes may be tensioned up to or slightly beyond the desired level at the anchorage or tensioning points, and then the intervening posts (in the direction of the line of the fence) may be disturbed so as to promote rope slip and the re-distribution of the tension. This procedure is repeated to effect a progressive tensioning of the whole fence stage, up to the desired level.

Figure 9:
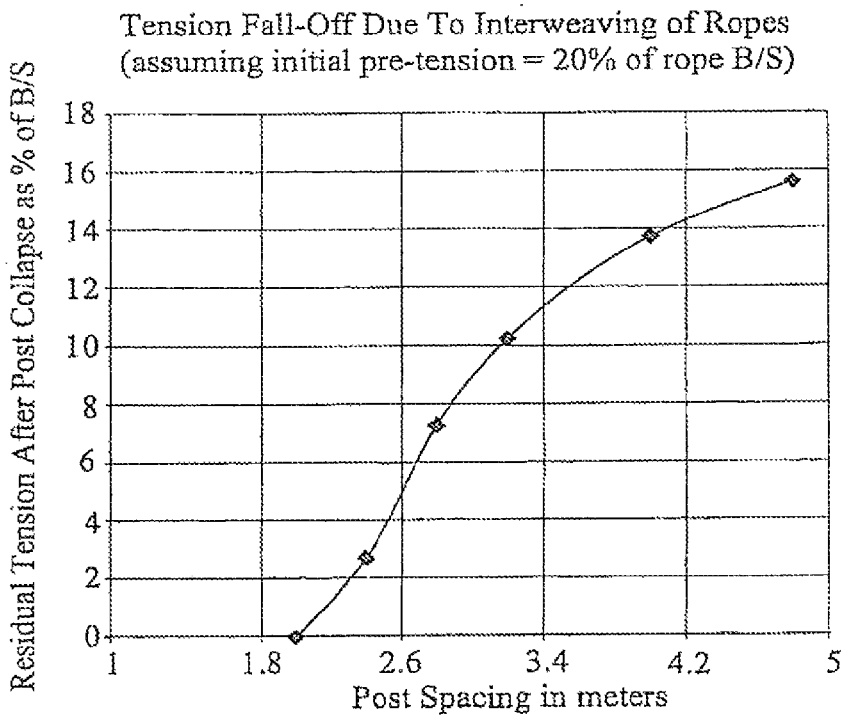
FIG. 9 is a graph showing tension fall-off due to rope interweaving.

Notwithstanding the effectiveness of this technique, the interwoven ropes suffer a significant loss in local tension when posts are collapsed by an impacting vehicle, as the angular (zigzag) deflection of the ropes is removed in the area of the collision. FIG. 9 illustrates this effect graphically by considering one (or more) post bays in isolation from the rest of the fence and assuming that the ropes are initially pre-tensioned to 20% of the breaking strength (B/S) of the ropes.

This is admittedly a worst case scenario and in practice a considerable amount of these tension losses will be taken up by the undisturbed rope in the adjoining fence bays. Nevertheless the residual tension in the ropes will be significantly less than if they had not been interwoven. This emphasizes the need for effective pre-tensioning of the ropes to the recommended level, if a degree of barrier integrity is to be maintained in the immediate post-crash period.

A consequence of these effects is that the interwoven ropes will tend to grip the posts tightly such that their combined frictional grip in the direction of the line of the fence exceeds the elastic bending strength of the posts in that direction. When interwoven upper ropes are introduced, there is therefore the prospect of posts being pulled over by the ropes in positions not directly affected by an impacting vehicle. This presupposes that the rope displacements are sufficiently large to induce flexural yielding of the posts. Significantly the direction of this movement will be towards the colliding vehicle. Therefore, in accordance with a preferred aspect of the present invention, the posts are constructed and/or their attachment to the ground is such that the yield strength in bending of the posts (in the direction of the line of the fence) exceeds the combined bending moment of the rope frictional forces.

The move to a fully interwoven barrier system in accordance with the present invention further alleviates this problem. Embodiments may be provided with means for supporting the ropes, which are frangible at the posts.

Worked Example:

Consider the case of a 4-rope interwoven barrier in which the ropes have a mean heist above ground level of 550 mm and posts at 2.4 m spacing, each having a depth of 100 mm. The resulting angular deviation of the ropes (in plan view relative to the line of the barrier) will be 2.38 degrees. If we assume for design purposes that each rope will see a tension of 50 kN, then it can be shown that the four ropes will generate a frictional grip on a post of 3.33 kN (taking the coefficient of friction to be 0.20). The effect of this force is to create a bending moment in the post which will reach a maximum of 1832 Nm (at the base of the post) before the ropes slip. The result of this bending moment in terms of maximum bending stress will vary with the strength and stiffness of the type of post selected as illustrated in the table below:

Comparison of Maximum Bending Stresses in Z-Posts at 2.4 m Centers

| Post dimensions mm D × W × Thickness | In-line moment of inertial $mm^4$ | Combined bending moment Nm | Maximum bending stress $N/mm^2$ |
|---|---|---|---|
| 100 × 32 × 6.0 | 66,700 | 1832 | 439 |
| 100 × 40 × 6.0 | 125,000 | 1832 | 293 |
| 120 × 50 × 6.0 | 245,000 | 2197 | 224 |

[assumes 50 kN rope tension and 550 mm mean rope height]

With the Standard (100×32×6 mm) post it was found that the maximum bending stress greatly exceeded the yield strength of the post, which is 275 MPa [for Fe430A grade material]. The use of a larger (100×40×6.0 mm) post was therefore considered but the maximum bending stress still marginally exceeded the Fe430A yield strength. In this instance the problem could be solved by using a higher grade of steel post, e.g. Grade Fe510A which offers a yield strength of 355 MPa. A possible alternative solution would be to use a yet larger post such as the 120×50×6 mm section. Whilst this increases the angular deviation of the ropes and the bending moment slightly, the maximum bending stress falls to 224 MPa, well below the normal yield strength of 275 MPa.

Although intuition would suggest that post failure would be caused by direct impact of a colliding vehicle on the post, it appears that (for a pre-tensioned wire rope safety barrier) the mode of collapse of the posts is more generally attributable to the longitudinal components of the tensions in the ropes, as they are deflected by the ingress of the vehicle beyond the line of the barrier. The angular deflection of the ropes increases rapidly as the vehicle approaches the (first) post, up to the point at which the yield point of the post is reached, whereupon the ropes are released from the first post, to apply a similar progressive force (and bending moment) to the next post in line.

In an interwoven barrier, only the ropes that are on the upstream side of the post in question (i.e. lie between it and the oncoming vehicle) can act to pull it down. Hence, provision of an even number of ropes would render the barrier to a more consistent resistance to vehicle penetration along its length. Similar considerations apply to the selection of an optimum interweaving pattern for the ropes, if the ropes are not being paired at the same height.

It is noted that in embodiments of the present invention, the aforementioned problem of posts being pulled over is less apparent in the regions of the barrier close to the ends where the ropes are anchored to the ground. This is because at posts close to the barrier ends, the effective stiffness of the ropes increases due to the relatively short length thereof between the post in question and the anchorage point. Consequently, the ropes near the end positions of the barrier tend to deflect less under crash conditions relative to positions further away from the ends. As a result the frictional resistance of the ropes against the posts in these positions is less likely to deflect the post sufficient to cause yielding in bending. Therefore, posts near the anchorage ends of the barrier need not necessarily comply with the minimum bending yield strength of the present invention.

The invention claimed is:

1. A post for use with a road safety barrier supporting a plurality of wire ropes, the post comprising:

a vertical member; and a longitudinally oriented indention formed in the surface of the vertical member to receive and support a first wire rope, the longitudinally oriented indention comprising:

a top; and a bottom;

wherein the bottom is substantially parallel with the ground such that the first wire rope may be released from the indention when force is exerted on the first wire rope, and wherein depth of the indention from the surface is less than a diameter of the first wire rope.

2. The post of claim 1 wherein the vertical member comprises a circular cross-section.

3. The post of claim 1 further comprising a ring supported on the vertical member to retain the wire rope within the longitudinally oriented indention.

4. The post of claim 3 wherein the ring is made of a plastic material.

5. The post of claim 1 wherein the top of the longitudinally oriented indention is curved.

6. The post of claim 5 wherein the top of the longitudinally oriented indention extends from a part of the bottom of the longitudinally oriented indention that is innermost relative to an outer periphery of the post.

7. The post of claim 6 wherein the bottom of the longitudinally oriented indention resists downward movement of the first wire rope during vehicle impact and wherein the top permits upward movement of the first wire rope.

8. The post of claim 1 wherein the top of the longitudinally oriented indention forms a 45 degree angle relative to a side of the vertical member.

9. The post of claim 1 further comprising a lip extending from the vertical member at the bottom of the longitudinally oriented indention.

10. The post of claim 1 wherein the bottom defines a perforation.

11. A road safety barrier comprising;

a plurality of posts, each post comprising a longitudinally oriented indention formed on a surface of a first side of the posts; and a plurality of ropes supported by the posts, the ropes held in tension along the length of the barrier and within at least one of the longitudinally oriented indentions;

wherein at least one of the longitudinally oriented indentions comprises a top and a bottom, and wherein the bottom is substantially parallel with the ground and such that the first wire rope may be released from the indention when force is exerted on the first wire rope, and wherein a depth of the indentation from the surface is less than a diameter of the first wire rope.

12. The road safety barrier of claim 11 wherein each post comprises a circular cross-section.

13. The road safety barrier of claim 11 further comprising a plurality of rings supported on the posts to retain the wire rope within the longitudinally oriented indentions.

14. The road safety barrier of claim 11 wherein the bottom comprises a perforation.

15. A wire rope support for use in a road safety barrier, the support comprising;

a vertical member; and a first longitudinally oriented indention formed on a surface of a first side of the vertical member, the first longitudinally oriented indention comprising a top and a perforated bottom;

wherein the bottom is substantially parallel with the ground such that a wire rope may rest within the indention, and;

wherein a depth of the indentation from the surface is less than a diameter of the first wire rope.

16. The support of claim 15 wherein the top of the first longitudinally oriented indention is curved.

17. The support of claim 15 wherein the top of the first longitudinally oriented indention forms an angle relative to the vertical member.

18. The support of claim 15 further comprising a lip extending from the vertical member at the bottom of the first longitudinally oriented indention.

19. The support of claim 15 wherein the wire rope is biased to release upwards from the indention when a force is exerted on the first wire rope.

20. The support of claim 15 further comprising a second indention formed on the vertical member, the second indention comprising an arcuate top and an arcuate bottom, and wherein the second indention is located below the longitudinally oriented indention.

21. A road safety barrier comprising;

a plurality of posts mounted on or in the ground, each post comprising a longitudinally oriented indention formed on a surface of a first side of the posts, the barrier having a length in a direction from one post to another; and a plurality of ropes supported by the posts, each rope following a sinuous path between the posts and held in tension along the length of the barrier and within at least one of the longitudinally oriented indentions;

wherein at least one of the longitudinally oriented indentions comprises a top and a bottom, wherein the bottom is substantially parallel with the ground and such that the first wire rope may be released from the indention when force is exerted on the first wire rope;

wherein a depth of the indentation from the surface is less than a diameter of the first wire rope;

wherein the structure of at least some of the posts with respect to the ground defines a minimum bending yield strength in a direction along the length of the barrier;

wherein said minimum bending yield strength is greater than the bending moment of the post such that at least some of the posts remain upright to overcome frictional forces of the ropes on the posts in the event of an impact on the barrier in an area of the barrier that does not include some of the posts; and wherein at least most of the posts are configured such that they exhibit a preferential mode of collapse in a direction along the length of the safety barrier, relative to the transverse direction.

* * * * *